US006802629B2

(12) United States Patent
Krietzman et al.

(10) Patent No.: US 6,802,629 B2
(45) **Date of Patent: *Oct. 12, 2004**

(54) IEEE 1394 OR USB POWERED COMPUTER LIGHTS

(75) Inventors: Mark Howard Krietzman, Palos Verdes Estates, CA (US); Yu-Hsin Chen, Palos Verdes Estates, CA (US)

(73) Assignee: Acco Brands, Inc., Lincolnshire, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/208,533

(22) Filed: Jul. 30, 2002

(65) Prior Publication Data

US 2002/0186563 A1 Dec. 12, 2002

Related U.S. Application Data

(63) Continuation-in-part of application No. 09/862,885, filed on May 21, 2001, now Pat. No. 6,575,593.

(51) Int. Cl.[7] ..... F21S 8/08

(52) U.S. Cl. ..... 362/414; 362/413; 362/394; 362/395; 362/396; 362/427; 362/109; 362/98

(58) Field of Search ..... 362/253, 198, 362/199, 287, 427, 800; 439/166, 170, 171, 173

(56) References Cited

U.S. PATENT DOCUMENTS

| | | | | |
|---|---|---|---|---|
| 5,882,109 A | * | 3/1999 | McKinney et al. | 362/477 |
| 6,533,616 B2 | * | 3/2003 | Johnsen et al. | 439/668 |
| 6,575,593 B2 | * | 6/2003 | Krietzman | 362/199 |
| 2001/0048597 A1 | * | 12/2001 | Krietzman et al. | 362/201 |

* cited by examiner

*Primary Examiner*—Sandra O'Shea
*Assistant Examiner*—Mark Tsidulko
(74) *Attorney, Agent, or Firm*—Townsend and Townsend and Crew LLP

(57) ABSTRACT

A light for use with computers containing light emitting diodes, which may be directional, on one or more movable supports which is powered via the computer's USB or IEEE 1394 port. An auxiliary USB or IEEE 1394 port may be combined with the plug-in light to allow for additional devices to be connected through the same port powering the light.

29 Claims, 3 Drawing Sheets

IEEE 1394 OR USB POWERED COMPUTER LIGHTS

RELATED APPLICATIONS

This application is a continuation-in-part of U.S. patent application Ser. No. 09/862,885 filed May 21, 2001 now U.S. Pat. No. 6,575,593 entitled "IEEE 1394 or USB Powered Computer Light"

BACKGROUND OF THE INVENTION

1. Field of the Invention

This present invention relates to a LED lamp for use with desktop, laptop and palmtop computers. More specifically, to a LED illuminator powered via the USB or the IEEE 1394 port.

2. Related Art

Reading papers next to a laptop computer and/or seeing the keys on a keyboard, in dimly lit areas such as airplanes and lecture halls can present a difficult task. Flooding the area around the computer with overhead lights can be difficult, impossible, impractical or impermissible.

Applicants, patent application Ser. No. 09/862,885 entitled "IEEE 1394 or USB Powered Computer Light" provides a USB or IEEE 1394 powered computer light which can solve some lighting problems. It would also be desirous to have a computer powered light which has selectable illumination sources, spectrum, and/or output directions.

SUMMARY OF INVENTION

The present invention is a computer powered light with one or more light emitting diodes (LED) as the illumination source. The computer powered light plugs into a female USB or IEEE 1394 port and draws its power from the USB or IEEE 1394 port. One or more Light emitting diodes are supported on at least one movable support member for easy positioning. The movable support may have a bendable necks or flexible and rigid sections Each of the one or more LEDs may have similar or dissimilar fan angle of light dispersion. LEDs may have similar or dissimilar output wavelengths in visible or non-visible spectral regions.

Power drain on the computer can be minimized with current limiting circuitry supplying the power to the LEDs. The LEDs may be default "on" or switched. Switched LEDs may be switched separately, or they may be switched together. Current balancing circuitry may be included when powering multiple LEDs in series, particularly for those embodiments which use LEDs with different spectral outputs that have dissimilar nominal current and/or amperage requirements.

In some embodiments one or more of the LEDs are placed in a movable LED receiving head to direct the illumination in addition to the directional orientation from the movement of the movable support member.

In some embodiments the connector body is height adjustable. Aligning the bottom of the connector body with the bottom of the desktop, laptop, notebook or palmtop computer, to which it is affixed provides additional support for the IEEE 1394 or USB powered computer light.

Some computers have only a single, or a limited number of, USB or Firewire (IEEE 1394) ports. Accordingly the computer light may be configured to provide an auxiliary "pass-through" USB or IEEE 1394 port to allows additional connections to the computer through the same port powering the light.

The features of the invention believed to be novel are set forth with particularity in the appended claim. The invention itself, however, both as to configuration, and method of operation, and the advantages thereof, may be best understood by reference to the following descriptions taken in conjunction with the accompanying drawings.

DETAILED DESCRIPTION OF THE PREFERRED EMBODIMENTS OF THE INVENTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

Figure 1A:
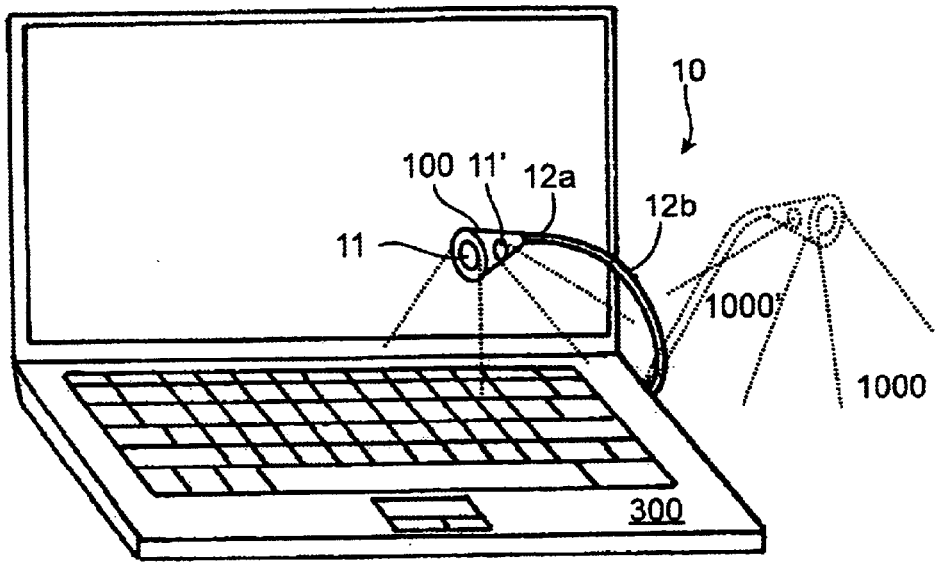
FIG. 1A is a front perspective view of the preferred embodiment of the computer light attached to a computer.
Figure 1B:
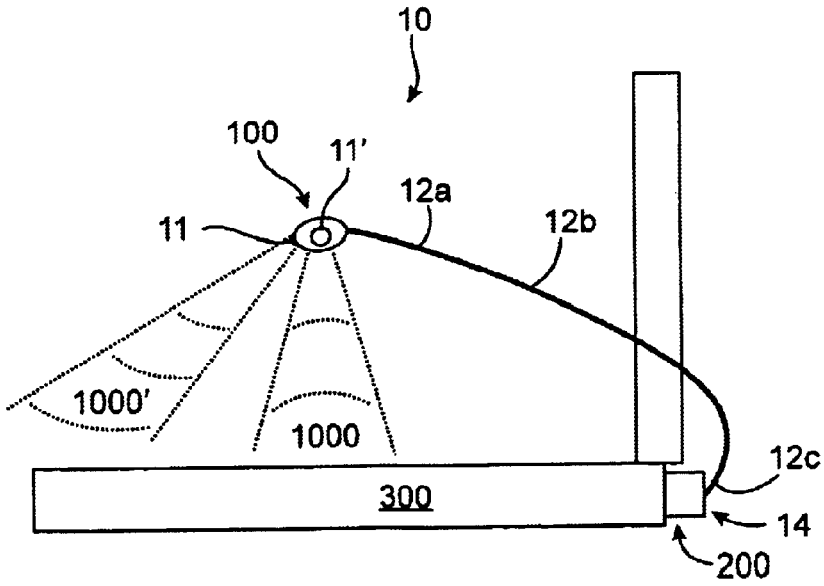
FIG. 1B is a side view of the preferred embodiment.
Figure 1C:
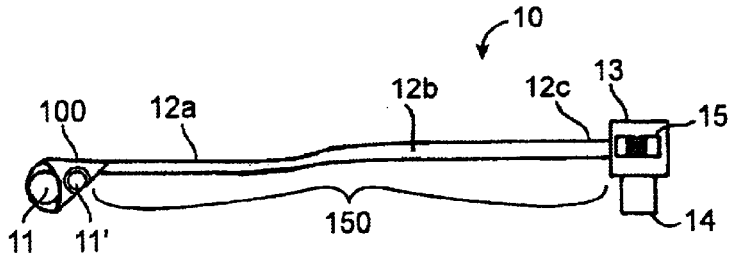
FIG. 1C is an unattached view of the computer light of FIG. 1A.

For the preferred embodiment shown in FIGS. 1A, 1B & 1C a first and a second light-emitting diode "LED" 11 & 11' are affixed to a LED receiving head 100 at a first end 12*a* of a movable support member 150 which has flexible neck which is attached via a second end 12*c* to a connector body 13. While a flexible neck is indicate in this embodiment a rigid or semi-rigid neck such as those described in reference to FIG. 11 may be substituted. An USB or an IEEE1394 male jack 14 which can mate with either a USB, or a IEEE 1394, port 200 on a computer 300 is also attached to the connector body 13.

The first and second LEDs 11 & 11' are conductively linked to the male jack 14 via long conductive lead wires (not shown). When the male jack 14 is plugged into the USB or IEEE 1394 port 200, power is supplied to the LEDs 11 &

11' to produce a first and second illumination 1000 & 1000'. The illumination from the computer powered light can be provided to a selected area by directing the illumination from the light emitting diodes via the alteration of the position of the flexible neck.

Light emitting diodes 11 & 11' useful for this illuminator include, but are not limited to, those associated with wavelength in a specific spectral region, (visible or non-visible) such as red light, blue light, or yellow light, IR, UV and those which produce a wide spectrum (white light) comprising more than one distinct spectral region of light. Each LED has an integral lens element (not shown) which determines the fan angle of light dispersion. The construction of a light emitting diode with an Integral lens element is well known and therefore a detailed description of the construction has not been provided.

In FIG. 1C an "on/off" slide switch 15, which is a multi-function switch controlling the current to both LEDs allowing selective turning "on" and "off" of the LEDs 11 & 11' separately or together, is shown integrated into the connector body 13 from which extends the male jack 14. The integration of the "on/off" switch 15 into the connector body is not a limitation and those skilled in the art will recognize that in some instance it may be useful to locate the "on/off" switch on the receiving head or the flexible neck.

Figure 2:
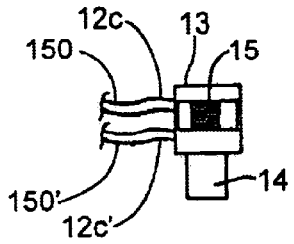
FIG. 2 is a partial view of another embodiment of the computer light with dual movable support members.

In FIG. 2 a partial view of the connector body 13 with dual movable support members 150 and 150' attached is shown. The on/off slide switch 15, in this embodiment switches the current on/off for one or both of the LEDs (not shown). If LEDs of different spectral with different amperage and/or voltage requirements are used, the power from the computers USB or IEEE 1394 port 200 can be balanced for each LED with the current limiting circuitry described in reference to FIGS. 4 & 5.

Figure 3:
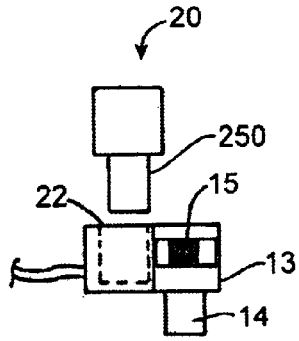
FIG. 3 is a partial view of another embodiment with pass-through USB or IEEE 1394 port.

In FIG. 3 shows a partial view of the connector body 13 with a pass-through USB or IEEE 1394 port, generally designated 20. The auxiliary female USB or IEEE 1394 port 22 is connected to, or formed as part of, the connector body 13 which is able to receive an auxiliary USB or IEEE 1394 plug 250 from a peripheral component such as a printer, keyboard, mouse, digital camera, video, scanner, zip drive and the like. The current to the auxiliary female USB or IEEE 1394 port 22 is non-switched. Therefore, the current is not interrupted when the "on/off" slide switch is on the connector body 13 is switched.

Figure 4:
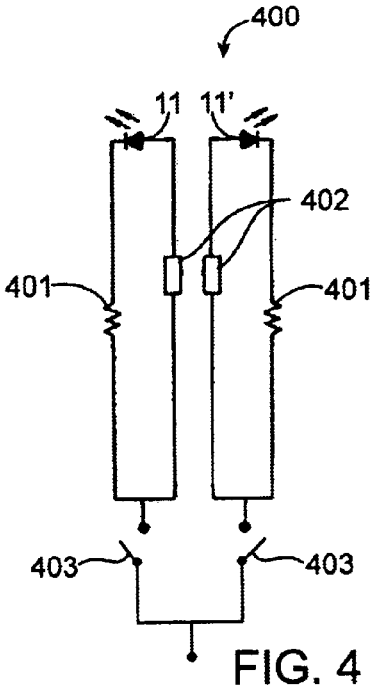
FIG. 4 is a circuit schematic for the preferred embodiment.
Figure 5:
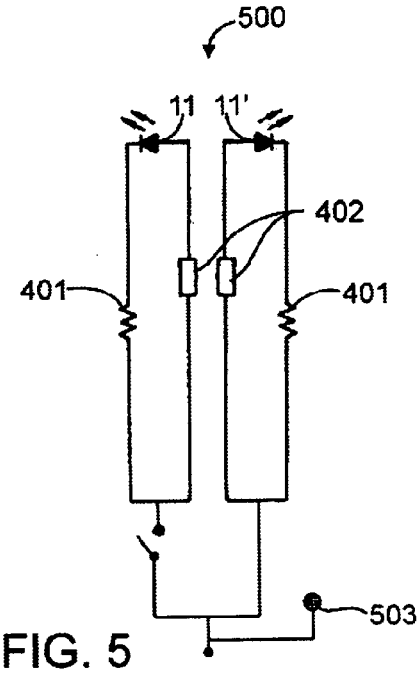
FIG. 5 is an alternate circuit schematic for the computer light.

Referring now to FIGS. 4 & 5 there are illustrated a circuit schematic for the computer light generally designated 400 & 500.

Power draw from the computer 300 and the power supplied to the LEDs can be controlled by limiting the voltage and/or amperage to either LED 11 & 11' by having a resistor 401 and/or other device such as an EPROM chip or R/C circuit 402 in the circuit. The on/off switch 403 can be used to power one (FIG. 4) or both (FIG. 5) of the LEDs 11 & 11'.

A powered USB or IEEE 1394 female port 503 which shunts off the computers powered port, and is thereby not effected by the on/off switch 403 is shown in FIG. 5.

Figure 6:
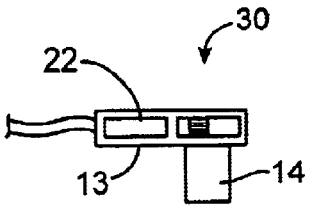
FIG. 6 is a partial view of another embodiment with a perpendicular pass-through USB or IEEE 1394 port.

In FIG. 6 a partial view is provided of a connector body 13 with a perpendicular auxiliary female USB or IEEE 1394 port 22, generally designated 30, is shown.

The auxiliary female USB or IEEE 1394 port 22 can receive an auxiliary USB or IEEE 1394 plug from a peripheral component. The orientation of the auxiliary female USB or IEEE 1394 port 22, perpendicular to the orientation of the male jack 14, serves to reduce the protrusion of the auxiliary female USB or IEEE 1394 port 22 and any auxiliary USB or IEEE 1394 Plug.

Figure 7:
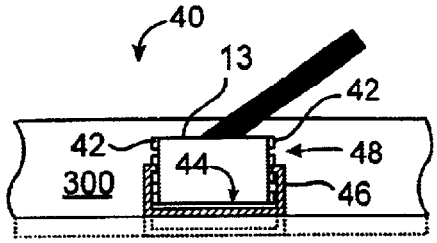
FIG. 7 is a partial view showing the adjustable connector body of an attached computer light.

In FIG. 7 an adjustable height connector body, generally designated 40 is shown. Extending from opposite sides of the connector body are pairs of spaced teeth 42. To raise the bottom 44 of the connector body 13, a movable platform 46 can be slideably engaged into a guide 48 formed between pairs of the teeth 42.

Figure 8:
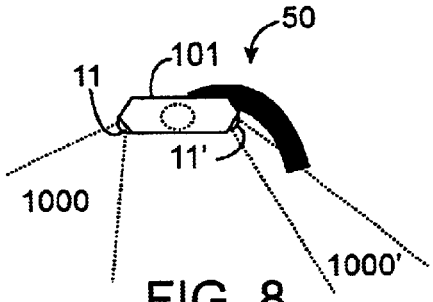
FIG. 8 is a partial view showing a single fixed receiving head with dual downward facing LEDs.

Shown in FIG. 8 is a partial view showing a single fixed receiving head 101 with dual downward facing LEDs 11 & 11', generally designated 50. Each LED 11 & 11' can produce a separate illumination 1000 & 1000'.

The illuminations may be of similar or dissimilar wavelength and/or fan angle of light dispersion. For instance, dissimilar wavelengths of light can be used to direct a red light at the keyboard which allows better viewing the keyboard with minimal interference of the images on the monitor 201 (FIG. 1A), and at the same time a whitish LED at material to the side of the computer, thereby providing a fuller spectrum illumination at the side for reading documents and the like.

The indication of a red or whitish LED directed at any particular area is not meant to act as a limitation.

Figure 9:
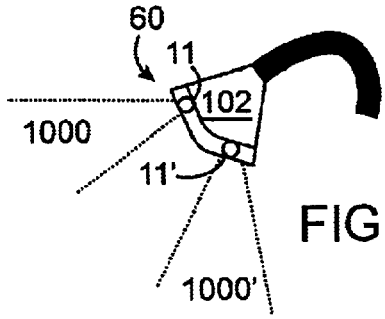
FIG. 9 is a partial view showing a single fixed receiving head with dual forward facing LEDs.

Shown in FIG. 9 is a partial view showing a single fixed receiving head 102 with dual forward facing LEDs 11 & 11', generally designated 60. Each LED 11 & 11' can produce a separate illumination 1000 & 1000'. The illuminations may be of similar or dissimilar spectral outputs (wavelengths) and/or fan angle of light dispersion.

Figure 10:
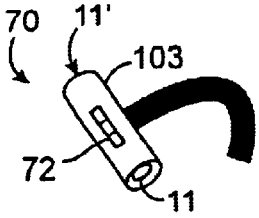
FIG. 10 is a partial view showing a single fixed receiving head with opposing LEDs.

Shown in FIG. 10 is a partial view showing a single fixed receiving head 103 with opposing LEDs 11 & 11', generally designated 70. Each LED 11 & 11' can produce a separate illumination. The illuminations may be of similar or dissimilar spectral output (wavelength) and/or fan angle of light dispersion. This embodiment is particularly useful to easily switch from one color spectrum illumination to another color spectrum illumination by switching from one LED 11 to the other LED 11'. Accordingly, a dual function on/off switch 72 is provided shown affixed on the receiving head 103.

Figure 11:
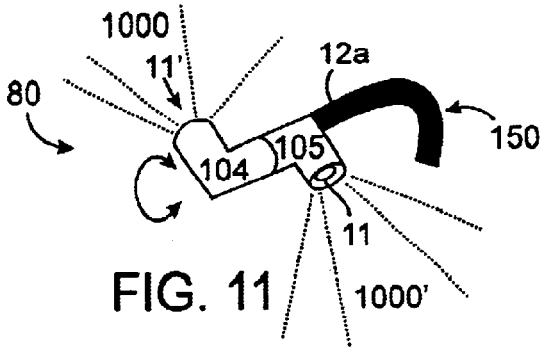
FIG. 11 is a partial view showing dual receiving heads.

Shown in FIG. 11 is a partial view showing a first and a second side facing receiving head 104 and 105 with LEDs 11 & 11', generally designated 80. The second receiving head 105 is movably mounted at the first end 12*a* of the movable support 150 whereby the output from the light emitting diodes 1000 & 1000' can be directed. The movable second receiving head 105 may also be mounted to the first receiving head 104.

Figure 12:
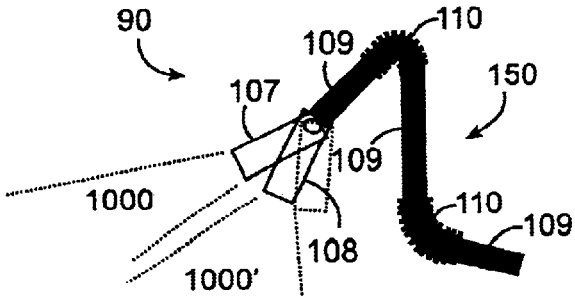
FIG. 12 is a partial view showing dual side facing receiving heads adjustable upward and downward.

Shown in FIG. 12 is a partial view showing a first and a second receiving head 107 and 108 with LEDs (not shown) and generally designated 90. The second receiving head 108 is movably mounted to the first receiving head 107. The movable support member 150 is constructed from one or more rigid sections 109 with flexible sections 110 interposed.

Since certain changes may be made in the above apparatus without departing from the scope of the invention herein involved, it is intended that all matter contained in the above description, as shown in the accompanying drawing, shall be interpreted in an illustrative, and not a limiting sense.

We claim:

1. A computer powered light comprising:

a male jack which mates with one of an USB or an IEEE 1394 port;

a movable support member affixed at one end to the male jack and with a second end; and, at least two visible spectrum light-emitting diodes affixed to the movable support member.

2. The computer powered light of claim 1, further comprising at least one LED receiving head affixed to the second end of the movable support member into which at least one of the light-emitting diodes is affixed.

3. The computer light of claim 2, wherein the at least one LED receiving head has at least one movable section whereby the output from a light emitting diode affixed therein can be directed.

4. The computer powered light of claim 1, further comprising an on/off switch, whereby at least one of the light emitting diodes may be switched "on/off".

5. The computer powered light of claim 1, further comprising an auxiliary female USB or IEEE 1394 port.

6. The computer powered light of claim 5, wherein the auxiliary female USB or IEEE 1394 port is formed as part of, or affixed to, the male jack.

7. The computer powered light of claim 5, wherein the auxiliary female USB or IEEE 1394 port is oriented perpendicularly to the male jack.

8. The computer powered light of claim 1, further comprising current limiting circuitry affecting the current supply to at least one of the light emitting diodes.

9. The computer powered light of claim 1, wherein at least one of the light-emitting diodes produces an illumination in the visible spectrum.

10. The computer powered light of claim 1, wherein each light emitting diode produces a spectral output in the visible spectrum.

11. The computer powered light of claim 1 further comprising a connector body supporting the male jack and the support member.

12. The computer powered light of claim 11, further comprising an auxiliary female USB or IEEE 1394 port formed as part of, or affixed to, the connector body.

13. The computer powered light of claim 11 wherein the connector body has adjustable height.

14. The computer light of claim 13 further comprising:

pairs of opposing teeth on opposite side of the connector body;

guides formed between teeth; and, a movable body which slideably attaches via the guides.

15. The computer powered light of claim 1, wherein each light emitting diode is connected to the male jack by conductive lead wires.

16. The computer powered light of claim 1, wherein at least one light emitting diode further comprises an integral lens element to produce an illumination with a predetermined fan angle.

17. The computer powered light of claim 1, wherein at least two light emitting diodes further comprises integral lens elements to produce an illumination with predetermined fan angles which may be similar or dissimilar.

18. A computer powered light comprising:

a male jack which mates with one of an USB or an IEEE 1394 port;

at least two support members each affixed at one end to the male jack and each with a second end; and at least one visible spectrum light-emitting diode affixed to each support member.

19. The computer powered light of claim 18, further comprising a LED receiving head affixed to at least one of the second ends of the support members into which at least one of the light-emitting diodes is affixed.

20. The computer powered light of claim 18, further comprising an on/off switch, whereby at least one of the light emitting diodes may be switched "on/off".

21. The computer powered light of claim 20, further comprising current limiting circuitry affecting the power supply to at least one of the light emitting diodes.

22. The computer powered light of claim 18, further comprising an auxiliary female USB or IEEE 1394 port.

23. The computer powered light of claim 18, wherein each light emitting diode produces an output in the visible spectrum.

24. The computer powered light of claim 18 further comprising a connector body supporting the male jack and at least one of the movable support members.

25. The computer powered light of claim 24, further comprising an auxiliary female USB or IEEE 1394 port formed as part of, or affixed to, the connector body.

26. The computer powered light of claim 25, wherein the auxiliary female USB or IEEE 1394 port is oriented perpendicular to the male jack.

27. The computer powered light of claim 18, wherein each light emitting diode is connected to the male jack by conductive lead wires.

28. A method of illuminating with a computer powered light the method comprising:

providing power to one or more visible spectrum light emitting diodes within a computer powered light via the computer's USB port; and directing the illumination from the computer powered light to illuminate a selected area.

29. The method of claim 28 the method further comprising directing the illumination from at least one light emitting diode by moving a movable support member to which at least one light emitting diodes is affixed.

* * * * *

UNITED STATES PATENT AND TRADEMARK OFFICE

CERTIFICATE OF CORRECTION

PATENT NO. : 6,802,629 B2
DATED : December 2, 2004
INVENTOR(S) : Mark Howard Krietzman It is certified that error appears in the above-identified patent and that said Letters Patent is hereby corrected as shown below:

Title page,

Item [75], delete "Yu-Hsin Chen, Palos Verdes Estates, CA (US)".

Item [56], References Cited, U.S. PATENT DOCUMENTS, please insert the following:

| | | |
|---|---|---|
| -- 2,211,591 | 08-13-1940 | Benander |
| 3,652,899 | 03-28-1972 | Henschen |
| 4,353,609 | 10-12-1982 | Haas |
| 4,679,877 | 07-14-1987 | Ahroni |
| 4,772,231 | 09-20-1988 | Hayes |
| 5,078,399 | 01-07-1992 | Lennon, Jr. |
| 5,247,314 | 09-21-1993 | Stephenson |
| 5,590,950 | 07-01-1997 | Hildebrand |
| 5,615,945 | 04-01-1997 | Tseng |
| 6,135,450 | 10-24-2000 | Huang et al. |
| 6,186,636 | 02-13-2001 | Naghi et al. |
| 6,238,291 B1 | 05-29-2001 | Fujimoto et al. |
| D435,679 | 12-26-2000 | Naghi et al. |
| D476,106 S | 06-17-2003 | Kim |
| 2001/0048409 A1 | 12-06-2001 | Kim -- |

FOREIGN PATENT DOCUMENTS, add the following:

| | | | |
|---|---|---|---|
| -- DE | 42 02 776 A1 | A1 | 08-05-1993 |
| DE | G 94 17 969.7 | | 03-16-1995 |
| EP | 0 478 802 A1 | A1 | 04-08-1992 |
| FR | 2 754 588 | | 04-17-1998 |
| JP | 04-070626 | | 03-05-1992 |
| JP | 04-333.023 | | 11-20-1992 |
| JP | 09-211448 | | 08-15-1997 |
| JP | 10-246886 | | 09-14-1998 |
| JP | 10-326659 | | 12-08-1998 |
| JP | 11-119206 | | 04-30-1999 |
| JP | 2000-330110 | | 11-30-2000 |

UNITED STATES PATENT AND TRADEMARK OFFICE

CERTIFICATE OF CORRECTION

PATENT NO. : 6,802,629 B2
DATED : December 2, 2004
INVENTOR(S) : Mark Howard Krietzman It is certified that error appears in the above-identified patent and that said Letters Patent is hereby corrected as shown below:

Title page (cont'd),
OTHER PUBLICATIONS,
Stefan Peichl; Heidelber, Germany, Lighton V1.0; © 1999; pgs. 1-2; http://www.home.t-online.de/home/stefan.peichl --

Signed and Sealed this

Eighth Day of February, 2005

JON W. DUDAS
*Director of the United States Patent and Trademark Office*